US012163400B2

(12) United States Patent
Rutherford

(10) Patent No.: US 12,163,400 B2
(45) Date of Patent: Dec. 10, 2024

(54) PLUG AND ABANDON OPERATION IN A HYDROCARBON WELL BY CEMENTING THE ANNULUS THROUGH APERTURES IN THE CASING

(71) Applicant: CONOCOPHILLIPS COMPANY, Houston, TX (US)

(72) Inventor: James Rutherford, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 10 days.

(21) Appl. No.: 17/655,885

(22) Filed: Mar. 22, 2022

(65) Prior Publication Data

US 2022/0307345 A1 Sep. 29, 2022

Related U.S. Application Data

(60) Provisional application No. 63/167,228, filed on Mar. 29, 2021.

(51) Int. Cl.

| | |
|---|---|
| ***E21B 33/16*** | (2006.01) |
| ***E21B 34/14*** | (2006.01) |
| ***E21B 41/00*** | (2006.01) |

(52) U.S. Cl.

CPC ..... *E21B 33/16* (2013.01); *E21B 34/14* (2013.01); *E21B 41/0078* (2013.01)

(58) Field of Classification Search

CPC ..... E21B 33/16; E21B 41/0078; C21B 34/14

See application file for complete search history.

(56) References Cited

U.S. PATENT DOCUMENTS

| | | | |
|---|---|---|---|
| 2,156,207 | A | 4/1939 | Terrill |
| 3,052,298 | A | 9/1962 | Malott |
| 3,391,737 | A | 7/1968 | Havens |
| 5,060,724 | A | 10/1991 | Brammer et al. |

(Continued)

FOREIGN PATENT DOCUMENTS

| | | | |
|---|---|---|---|
| GB | 2581338 | A | 8/2020 |
| GB | 2583166 | A | 10/2020 |

(Continued)

OTHER PUBLICATIONS

Medetbekova, Maiya—"Production performance of radial waterjet drilled wells: a modeling and laboratory study", 2020, DTU Library; 184 pgs.

(Continued)

*Primary Examiner* — Silvana C Runyan

(74) *Attorney, Agent, or Firm* — CONOCOPHILLIPS COMPANY

(57) ABSTRACT

A technique for abandonment of a hydrocarbon well injects cement into the annulus through apertures (5) in the casing (3). The apertures (5) are pre-formed in the casing before the casing is installed at the start of life of the well, and are also fitted with a closure sleeve (6). The apertures (5) remain closed for the lifetime of the well. The closure sleeve (6) is designed to remain operational over the 20-30 year lifetime of the well. When the time comes to plug and abandon the well, a tool (9) is passed down the well on drill pipe (10) to open the apertures (5) by moving the sleeve (6). Wash fluid and then cement are injected from the tool (9) through the apertures (5) to wash and then plug the annulus behind the casing (3).

14 Claims, 3 Drawing Sheets

(56) References Cited

U.S. PATENT DOCUMENTS

| | | | | |
|---|---|---|---|---|
| 2004/0074645 | A1 | 4/2004 | Surjaatmadja | |
| 2012/0312539 | A1 | 12/2012 | Glass | |
| 2014/0231546 | A1 | 8/2014 | Etschel et al. | |
| 2015/0021025 | A1 | 1/2015 | Myhre et al. | |
| 2016/0010429 | A1 | 1/2016 | Getzlaf et al. | |
| 2016/0130903 | A1* | 5/2016 | Robertson | E21B 23/006 166/55 |
| 2016/0168971 | A1* | 6/2016 | Wood | E21B 33/126 166/308.1 |
| 2016/0194937 | A1 | 7/2016 | Myhre et al. | |
| 2016/0237779 | A1* | 8/2016 | Husby | E21B 33/13 |
| 2017/0067313 | A1* | 3/2017 | Connell | E21B 37/00 |
| 2018/0187518 | A1* | 7/2018 | Myhre | E21B 41/0078 |
| 2020/0040707 | A1 | 2/2020 | Watts et al. | |
| 2020/0173249 | A1 | 6/2020 | Fairweather | |
| 2020/0340332 | A1* | 10/2020 | Anderson | E21B 37/08 |
| 2022/0056782 | A1 | 2/2022 | Hovda et al. | |

FOREIGN PATENT DOCUMENTS

| | | | |
|---|---|---|---|
| WO | 2017041105 | A1 | 3/2017 |
| WO | 2017052378 | A2 | 3/2017 |
| WO | 2017058249 | A1 | 4/2017 |
| WO | 2019108776 | A1 | 6/2019 |
| WO | 2020028748 | A1 | 2/2020 |

OTHER PUBLICATIONS

Menter, F.R.—"Two-Equation Eddy-Viscosity Turbulence Models for Engineering Applications", 1994, AIAA Journal vol. 32, Issue No. 8, pp. 1598-1605.

Phadke, Amal, et al—"Application of Computational Fluid Dynamics for Parametric Optimization of Jet-Type P/W/C Technique", 2020, SPE-202441-MS, Society of Petroleum Engineers, pp. 1-28; 28 pgs.

Hovda, Lars, et al—"Best Practice for Cementing and Zonal Isolation Using the Jet-Type Perforate, Wash and Cement Technique", 2020, SPE-202397-MS, Society of Petroleum Engineers; 46 pgs.

Ferg, Thomas E.—"Novel Approach to More Effective Plug and Abandonment Cementing Techniques", 2011, SPE 148640-MS, Society of Petroleum Engineers; 13 pgs.

* cited by examiner

PLUG AND ABANDON OPERATION IN A HYDROCARBON WELL BY CEMENTING THE ANNULUS THROUGH APERTURES IN THE CASING

CROSS-REFERENCE TO RELATED APPLICATIONS

This application is a non-provisional application which claims benefit under 35 USC § 119 (e) to U.S. Provisional Application Ser. No. 63/167,228 filed Mar. 29, 2021 entitled "METHOD AND APPARATUS FOR USE IN PLUG AND ABANDON OPERATIONS," published as US. Pub. No. 2022/0307345 which is incorporated herein in its entirety.

STATEMENT REGARDING FEDERALLY SPONSORED RESEARCH

None.

FIELD OF THE INVENTION

This invention relates to the plugging of hydrocarbon wells for abandonment.

BACKGROUND OF THE INVENTION

At the end of the life of a hydrocarbon producing well or injector well, the well must be plugged and abandoned permanently. Stringent regulatory requirements exist for such operations. The full diameter of a well must be filled with good quality cement over a specified length to achieve a permanent barrier which will withstand a specified pressure.

Traditionally, before cementing, production tubing is pulled from the well and then either the casing is cut some distance down the well and then pulled out of the well or alternatively a long section of casing is milled away. Both methods create a section of well which is free of all steel and where a unitary cement plug can be set in rock. This involves considerable time and the availability of a drilling rig to perform the pulling or milling procedure, both of which require heavy machinery. It is thus expensive and uses resources whose availability may be constrained.

More recently, rather than pulling or milling the casing, the casing has been perforated and a tool then passed down the casing to inject wash fluid into the annular space outside the casing followed by cement to form a plug in the annulus. The interior of the casing can then be cemented to create a barrier across the full diameter of the well. This technique is known as "perf, wash and cement" (PWC). The applicant has filed a number of patent applications relating to this procedure, including for example published international application number WO2020028748A1 and US application number US 2022-0056782 A1, the contents of which are incorporated herein by reference.

Perforating the casing involves running a specialized "perf gun" down into the well which includes explosive charges to make apertures or perforations in the casing. Although this procedure works well, it can produce holes which are of irregular size and have burr around the edges. These things can cause the wash and cement process to be less predictable than desired. The perforating operation, including the cost of the perf gun itself, also obviously represents a cost in terms of equipment and time.

In other situations, such as in well completion, it is known to employ completion liner (tubing) with pre-formed apertures in the hydrocarbon reservoir. The apertures are closed off by a pre-installed sliding sleeve in the liner and may be opened or re-closed by passing a tool into the liner on drill string. This is described for example in international published patent application numbers WO2017/041105A1 and WO2019/108776A1, the disclosures of both of which are incorporated herein by reference. Completion of a well is a short term stage at the start of the life of a well, and the sleeve mechanism for opening and/or closing the apertures is only required to be functional for a limited period of time, e.g., a few weeks.

BRIEF SUMMARY OF THE DISCLOSURE

The inventor has appreciated that it may be possible when installing casing at the start of the life of a well to plan for its future abandonment by incorporating pre-formed apertures in the casing, which remain closed for the life of the well and are opened only when the time comes to abandon the well. For a relatively modest up front cost it may be possible to save the cost of the perforation procedure in a PWC abandonment operation, whilst also potentially making the wash and cement operations more reliable by having regular apertures free from burrs.

The invention more particularly includes a process for plugging a hydrocarbon well for abandonment, the process including:

a) installing in the well a casing or liner having pre-formed apertures and a closure member or members blocking the apertures;

b) during a plugging for abandonment procedure at the end of the life of the well, passing down the well an opening tool and moving the or each closure member with the tool in order to open the apertures; and c) delivering cement through the opened apertures to create a cement plug in an annulus outside the casing or liner.

The process may include, prior to step (c), delivering wash fluid through the opened apertures.

The casing or liner may be installed in overburden rock above a hydrocarbon reservoir: this would be the normal location for a permanent well barrier. In particular, the pre-formed apertures may be formed in an apertured section of the casing or liner, and the casing or liner may be installed such that the apertured section is in overburden rock above a hydrocarbon reservoir.

The step of opening the apertures and the step of delivering cement may be performed on the same trip into the well, which saves rig time and therefore cost. The step of opening the apertures, the step of delivering wash fluid and the step of delivering cement may, in fact, all performed on the same trip into the well.

The installation of the well casing or liner may be performed at the start of the life of the well; this is the normal time for casing/liner to be installed so it is advantageous that casing/liner with pre-formed selectively openable apertures be installed at this time.

In another embodiment, a length of casing or liner for installing in a well in overburden rock above a hydrocarbon reservoir is provided, wherein the length of casing or liner includes:

a) a plurality of pre-formed apertures;

b) one or more closure members blocking the apertures;

c) a mechanism for selectively opening the apertures in order to perform plugging of the well.

The closure member or members and the mechanism may be capable of remaining operational over the life of the well, e.g. for 10 years or more, such as from 10 to 30 years. This is desirable, especially if the liner/casing is the original liner/casing installed at the start of the well's life.

The or each closure member may comprise a sliding sleeve.

In another embodiment, a work string for a plug and abandon operation comprises (i) an opening tool for manipulating a closure member associated with an aperture in a liner or casing and (ii) a cementing tool for delivering cement through the aperture.

The work string may further comprise a wash tool for delivering wash fluid, such as drilling mud, through the aperture. The cementing tool and/or the wash tool may comprise a pair of packers spaced along the axial length of the tool and a nozzle or aperture located between the packers for dispensing cement or wash fluid under pressure.

Alternatively, the cementing tool and/or the wash tool may comprise a plurality of nozzles for creating jets of cement or wash fluid as the tool rotates.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead, these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figures 1, 2:
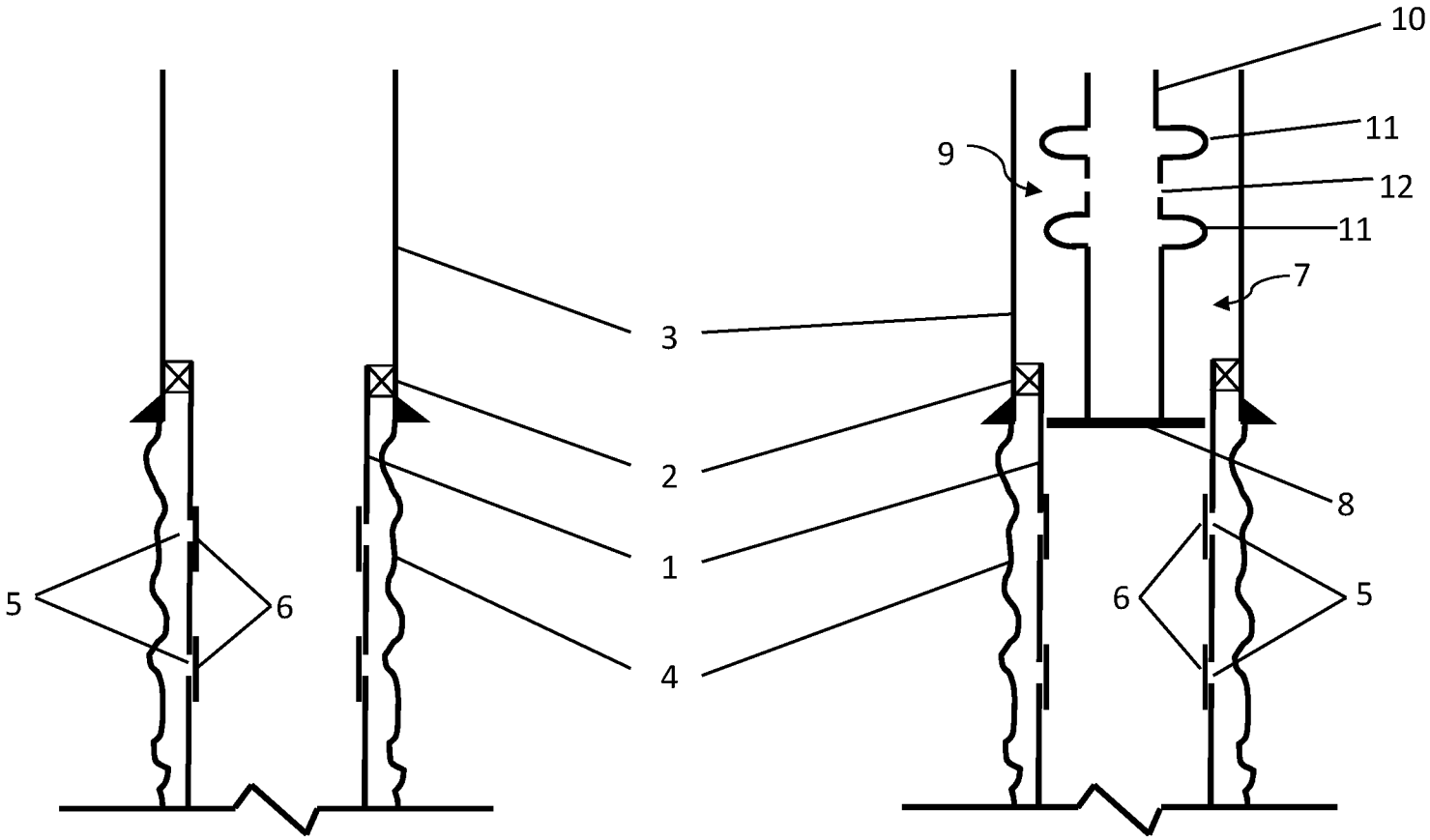
FIG. 1 is a section through a well showing a length of apertured casing according to the invention in place in the well.
FIG. 2 is a view similar to FIG. 1 showing a work string in accordance with the invention entering the apertured casing.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Plug and abandonment is required on all wells eventually in the well life cycle. Each area, for example Greater Ekofisk in the North Sea, will have specific guidelines and requirements to achieve barriers for temporary and permanent abandonment of wells.

The Greater Ekofisk Area (GEA) has its own distinct overburden barrier requirements that could benefit from a plug and abandon (P&A) tool "pre-installed" in a casing/liner string, i.e. installed in the string when the well is initially created. Each well has a P&A liability that the company takes on when drilling any well. Various technologies and historical methods of plugging and abandoning a well are time consuming and costly.

The GEA barrier requirements include: providing a cross sectional barrier across casing/formation that exceeds the formation integrity as tested by LOT (Leak Off Test) by 1000 psi; providing a hydraulic seal across the annulus between casing/liner and formation.

In general, P&A requirements, especially PP&A (permanent plug and abandon) requirements are very stringent compared with production requirements.

A method according to the invention will now be described for attaining a cross sectional barrier between casing and formation. The method involves a tool to be installed on original casing/liner to be utilized in late life P&A or PP&A (Plug and Abandon, Permanent Plug and Abandon). The tool is believed to meet the required V0 rating or equivalent ratings to casing/liner it is to be installed on. These ratings include API/ISO design validation, a gas test, testing for axial load, temperature cycling and testing for a bubble tight gas seal.

The geometry of the tool is within standard sizes of casing/liner: internal drift diameter equal to casing drift diameter; external outer diameter less than standard casing/liner collar. The need for increased outer diameter may also need to be evaluated based on design requirements such as pressure differential needed, increased cross sectional area to increase load capacity while allowing space for moving parts. Maximum OD would normally be designed around "normal" collar connections and/or reduced OD for reduced load capacity if necessary or if special clearance is required.

The proposed tool and method aim to attain a cross sectional barrier in late life of the well cycle. The proposed tool and method involve pre-installing ported sleeves in combinations or pairs to allow a circulation path up the annulus between casing/liner and formation up to required length of barrier. The ports are intended to allow circulation around the full 360 degrees of the casing/liner.

The ports may be designed as jets, e.g., angled up or down or laterally. They may also be fitted with inserts of hard wearing material to allow jetting of cement or wash fluid (mud) without significant erosion of the port. In this way, suitable jetting forces/pressures may be generated to effect thorough displacement of existing fluid in the annulus. Multiple rows of ports may be provided. Separate ports for wash fluid and cement may be provided, each optimized to achieve effective flow of wash fluid and cement, respectively. Further details of the properties of the ports and flow rates and pressures, etc. may be found in the applicant's co-pending patent application WO2020028748A1 and US 2022-0056782 A1, the contents of which are incorporated herein by reference.

The tool is to be run/conveyed as an integral component of casing/liner. It is to have the same, or more stringent, design limits than the casing/liner, including burst, collapse and axial strength. Top and bottom connections may be provided to complement the remainder of the work string as required but may include standard American Petroleum Institute (API) threaded connections and/or proprietary connections. The tool is to be V0 rated—the highest rating for production casing/liner—since the tool will sit "dormant" for the life of production of well and needs to be confirmed as a barrier within the string.

The tool is to be activated using a shifting tool conveyed on drill pipe. The shifting tool may have packer type assembly to seal around ports to direct flow from inside the drill pipe through ports to the annulus. The shifting tool may be part of a tool string which also includes wash and cement tools, so that only one trip into the well is required to perform the operation of creating apertures, washing behind the casing and then cementing behind the casing (and also in the casing bore).

The overall goal of this technology is a method to achieve isolation as a barrier across required P&A depths by introducing an integrated solution into the initial installation of casing/liners in new production wells. These types of tools (sleeves) are utilized for production/stimulation and secondary cementing operations currently in the industry. By capitalizing on current technology utilized in a new way, a cheaper PP&A solution can be achieved.

Referring now to FIG. 1, a section of perforated casing 1 is suspended from a liner hanger 2 in a larger diameter casing 3. The rock formation wall surrounding the perforated casing is shown at 4. The perforated casing 1 includes a number of pre-formed perforations 5 which are distributed along the axial length of the perforated casing as well as around its circumference. Closure members 6, of a type generally known in the oil and gas field, cover the apertures.

FIG. 2 shows a work string 7 entering the perforated casing 1. The work string 7 comprises a shifting tool 8 and a washing/cementing tool 9 carried on drill pipe 10. The washing/cementing tool 9 comprises a pair of packer elements 11 separated axially by short distance. Between the packers 11 are nozzles 12 arranged circumferentially around the tool 9. In the illustrated embodiment a single ring of nozzles is represented but there may be additional nozzles 12 spaced axially within the region between the packers 11. In FIG. 2 a combined wash and cement tool 9 is shown, but another possibility is to have separate tools for the wash and cement processes, each optimized for delivering their respective fluid. FIG. 2 shows the shifting tool 8 and wash/cement tool 9 on the same work string. This is the preferred arrangement since both operations may then be conducted in a single run into the well, but in an alternative embodiment the tools could be run separately.

Figure 3:
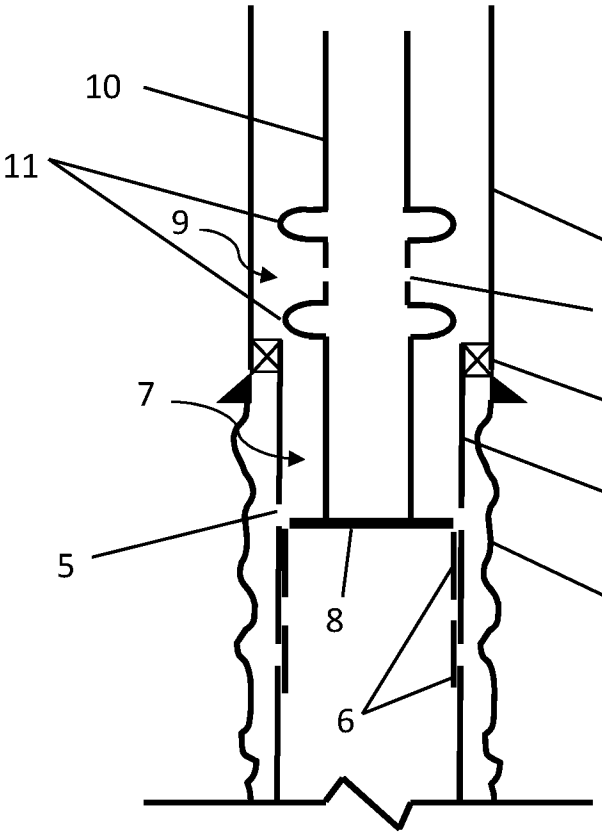
FIG. 3 is a view similar to FIG. 2 showing the work string further advanced into the casing to open apertures of the casing.

FIG. 3 shows the work string 7 advanced further into the perforated casing 1. The shifting tool 8 has engaged with the upper (more proximal) of the two sliding sleeve closure members 6 and has moved it to expose the upper (more proximal) set of apertures/perforations 5.

Figure 4:
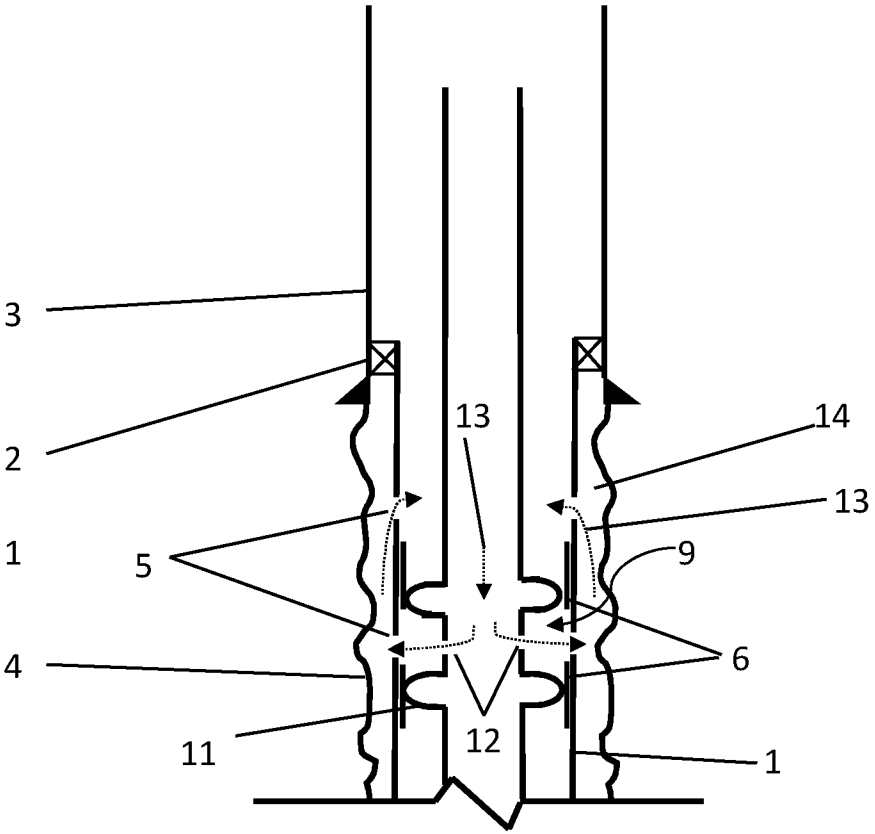
FIG. 4 is a view similar to FIG. 3 showing the work string still further advanced into the casing and circulating fluid through the opened apertures of the casing.

FIG. 4 shows the work string 7 further advanced such that both closure sleeves 6 have been moved and both sets of apertures 5 are open. The packers 11 are engaged with the interior of the perforated casing 1 above and below the lower (more distal) of the two sets of perforations. Wash fluid (e.g. drilling mud) is passed under pressure through the nozzles 12 in the wash/cement tool 9 between the packers 11. The packers above and below the apertures 12 create a relatively small volume in which relatively high pressure may be generated to force the fluid through the lower/distal apertures 5 in the casing 1 and into the annular volume (or annulus) 14 between the rock formation 4 and the perforated casing 1. The fluid then circulates back through the upper (distal) set of apertures 5. The flow of wash fluid is indicated by arrows 13. In this way the annulus 14 is cleaned and prepared for a cement; the wash fluid dislodges debris in the annulus 14 which is either carried away with the circulating flow or drops down the annulus.

It should be understood that a relatively small section of casing is shown for illustration. There would normally be many sets of apertures 5 along a length of casing corresponding to the length of cement plug which needs to be created. This may be, for example, 200 feet. The work string may move incrementally between successive sets of apertures or, more normally, would move in a continuous manner.

Once the washing step has been completed, the tool would then deliver cement in the same manner to the annulus 14. Cement may be delivered as the work string moves upwardly/distally through the casing, at the same time filling the interior of the casing with cement. Alternatively, an additional tool, similar in most respects to the tool 9 but adapted for delivering cement, may be assembled to the work string. Additional, selectively openable, nozzles may be provided distally of the tool 7 for dispensing cement to fill the interior of the casing.

Figure 6:
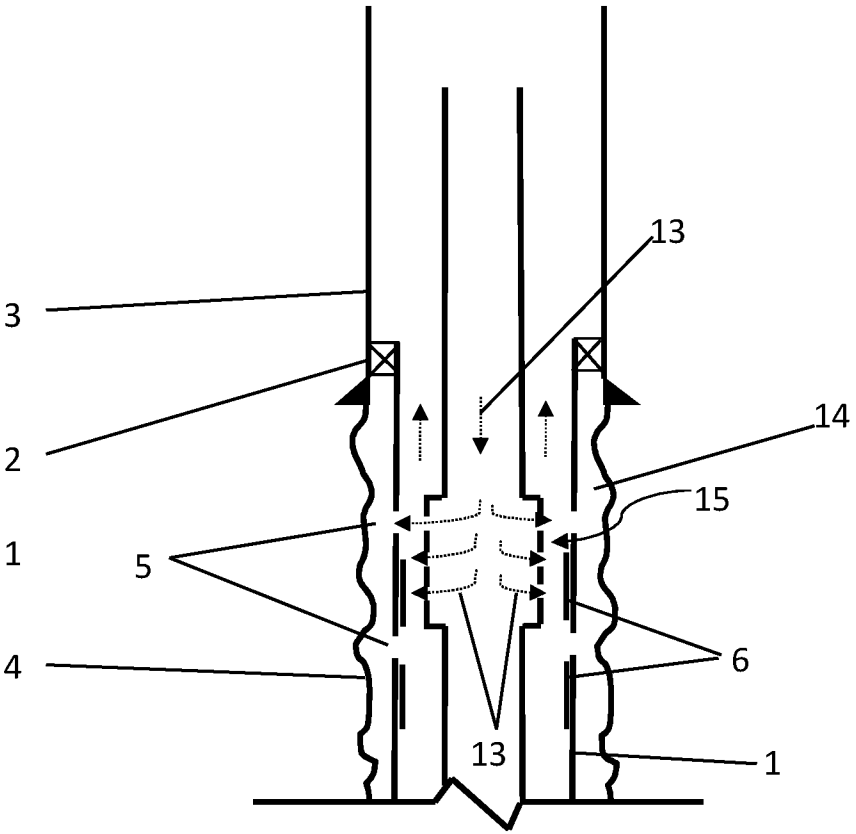
FIG. 6 is a view similar to FIG. 4 of the second embodiment of the invention.
Figure 5:
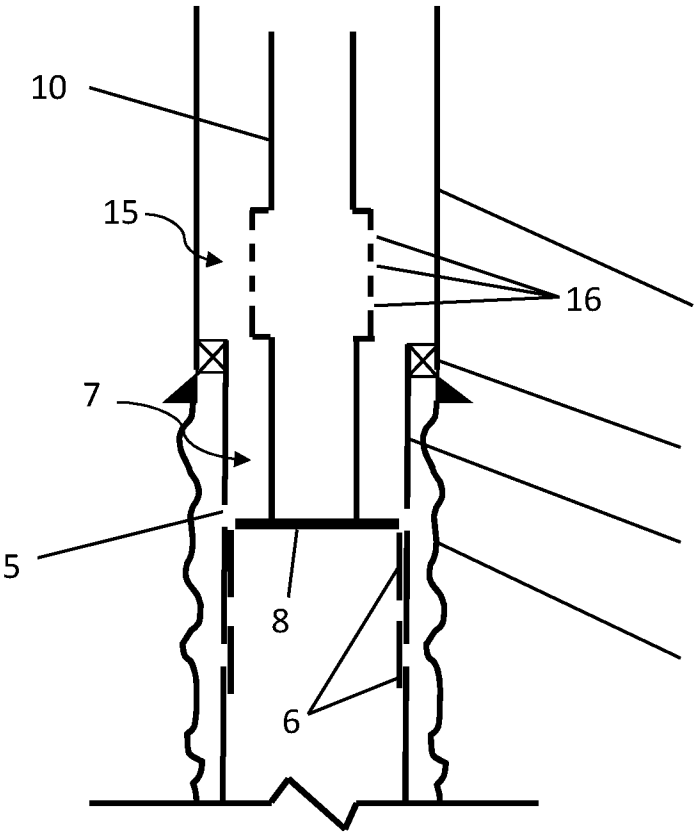
FIG. 5 is a view similar to FIG. 2 of a second embodiment of the invention.

FIGS. 5 and 6 show another embodiment in which a jetting wash/cement tool 15 is used instead of the arrangement with packers. As with the previous embodiment, the tool 15 may be a combined tool or separate wash and cement tools may be provided which are optimized for the delivery of their respective fluids.

The jetting tool 15 is essentially a cylinder with a number of nozzles 16 arranged around the circumference and also axially. The work string comprising shifting tool 8 and jetting tool 15 is passed down and up the casing in much the same way as the first embodiment, although the jetting tool would be rotated in addition to moving axially. Pressurized jets of wash fluid or cement as appropriate are injected through nozzles 16 and create pressure pulses in the surrounding fluid in the annuli between casing and formation. These pulses clean and dislodge debris in the annulus 14. Fluid circulates back up through the annulus between drill string and casing, as with the previous embodiment (arrows 13). The interior of the casing 1 is also filled.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. WO2017/041105A1 (National Oilwell Varco) "Apparatus, Systems and Methods for Multi-Stage Stimulation" (2017).
2. WO2019/108776A1 (National Oilwell Varco) "Multi-Zone Hydraulic Stimulation System" (2019).
3. WO2020/028748A1 (ConocoPhillips) "Behind Casing Wash and Cement" (2020).
4. US 2022-0056782 A1 (ConocoPhillips) "Behind Casing Wash and Cement" (2020).

The invention claimed is:

1. A process for plugging a hydrocarbon well for abandonment, the process including:

a) providing a casing or liner having apertures pre-formed therein, wherein the pre-formed apertures are formed in an apertured section of the casing or liner;

b) providing one or more closure members, wherein said closure members block all said pre-formed apertures;

c) drilling a hydrocarbon well;

d) installing said casing or liner in said hydrocarbon well at a start of a producing life of said well, wherein the said apertured section is installed in overburden rock above a hydrocarbon reservoir;

e) said apertures, blocked by said closure members, remaining unopened for said producing life of said well;

f) after said producing life of said well has ended, conducting a plugging for abandonment procedure, wherein said procedure comprises passing down said well an opening tool and moving one or more of said closure members with said tool, thereby opening one or more of said apertures; and g) delivering cement through said opened apertures to create a cement plug in an annulus outside said casing or liner, wherein said cement is delivered using a cementing tool comprising a plurality of nozzles for creating jets of cement.

2. The process according to claim 1 including, prior to step (g), delivering wash fluid through the opened apertures.

3. The process according to claim 1, wherein the casing or liner is installed in overburden rock above a hydrocarbon reservoir.

4. The process according to claim 1, wherein opening one or more of said apertures and delivering cement are all performed on a single trip into the well.

5. The process according to claim 2, wherein opening one or more of said apertures, delivering wash fluid and delivering cement are all performed on a single trip into the well.

6. The process according to claim 1, wherein the installation of the well casing or liner is performed at the start of the life of the well.

7. The process according to claim 1, wherein the casing or liner includes a mechanism for selectively opening the apertures in order to perform plugging of the well.

8. The process according to claim 7, wherein the closure member or members and the mechanism are capable of remaining operational for a length of time selected from about 10, 15, 20, 25, 30, 35, or 40 years.

9. The process according to claim 7, wherein the closure member or members and the mechanism are capable of remaining operational for the life of the well.

10. The process according to claim 7, wherein one or more closure member comprises a sliding sleeve.

11. The process according to claim 1, wherein the process is carried out using a work string for a plug and abandon operation, wherein the work string comprises (i) an opening tool for manipulating a closure member associated with an aperture in a liner or casing and (ii) a cementing tool for delivering cement through the aperture.

12. The process according to claim 11, wherein the work string comprises a wash tool for delivering wash fluid, such as drilling mud, through the aperture.

13. The process according to claim 11, wherein the wash tool, the cementing tool, or the wash tool and cement tool comprise a pair of packers spaced along the axial length of the tool and a nozzle or aperture located between the packers for dispensing cement or wash fluid under pressure.

14. The process according to claim 11, wherein the wash tool, the cementing tool, or both the wash and cementing tool comprise a plurality of nozzles for creating jets of wash fluid or cement as the tool rotates.

* * * * *